US008357327B2

(12) United States Patent
Schlüter et al.

(10) Patent No.: US 8,357,327 B2
(45) Date of Patent: Jan. 22, 2013

(54) HEATING DEVICE FOR PREHEATING A LIQUID-METAL TRANSFER CONTAINER

(75) Inventors: Jochen Schlüter, Dortmund (DE); Guido Kleinschmidt, Moers (DE); Walter Weischedel, Meerbusch (DE); Udo Falkenreck, Bochum (DE); Norbert Uebber, Langenfeld (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 230 days.

(21) Appl. No.: 12/227,326

(22) PCT Filed: May 11, 2007

(86) PCT No.: PCT/EP2007/004195

§ 371 (c)(1),
(2), (4) Date: Aug. 31, 2010

(87) PCT Pub. No.: WO2007/131721

PCT Pub. Date: Nov. 22, 2007

(65) Prior Publication Data

US 2010/0314809 A1 Dec. 16, 2010

(30) Foreign Application Priority Data

May 16, 2006 (DE) ..... 10 2006 022 689
May 11, 2007 (DE) ..... 10 2007 022 684

(51) Int. Cl.
*C21C 7/072* (2006.01)

(52) U.S. Cl. ..... 266/44; 266/901

(58) Field of Classification Search ..... 266/44, 266/901

See application file for complete search history.

(56) References Cited

U.S. PATENT DOCUMENTS

| | | | | |
|---|---|---|---|---|
| 4,090,054 | A | 5/1978 | Heine et al. | |
| 6,540,957 | B1 * | 4/2003 | Hara et al. | 266/44 |
| 2006/0035190 | A1 * | 2/2006 | Hoetger et al. | 431/329 |
| 2010/0314809 | A1 * | 12/2010 | Schluter et al. | 266/44 |

FOREIGN PATENT DOCUMENTS

| | | | |
|---|---|---|---|
| DE | 36 37 065 | | 5/1988 |
| DE | 19904921 | | 8/2000 |
| DE | 102 28 411 | | 9/2003 |
| EP | 1 078 704 | | 2/2001 |
| EP | 1078704 | A1 * | 2/2001 |
| FR | 2 706 991 | | 12/1994 |
| FR | 2 867 097 | | 9/2005 |
| JP | 51141725 | | 12/1976 |
| JP | 60 247464 | | 12/1985 |

(Continued)

OTHER PUBLICATIONS

Kellner et al: "Markteinführung Des Porenbrenners . . . ", Internet Citation, [Online]2005, XP002440186.

(Continued)

*Primary Examiner* — Scott Kastler
(74) *Attorney, Agent, or Firm* — Lucas & Mercanti, LLP; Klaus P. Stoffel

(57) ABSTRACT

A heating device for preheating a container (3), such as a transfer ladle, transferring liquid metal in melting operations, which is lined with refractory material, wherein the container is heated in a heating stand (1) having a container closure lid (2), is characterized by the use of porous burners (7) for heating the container (3) and keeping it warm.

5 Claims, 2 Drawing Sheets

FOREIGN PATENT DOCUMENTS

| | | |
|---|---|---|
| JP | 05-057425 | 3/1993 |
| JP | 05 057425 | 3/1993 |
| JP | 7077309 | 3/1995 |
| JP | 07112269 | 5/1995 |
| JP | 07-246456 | 9/1995 |
| JP | 2001235107 | 8/2001 |
| JP | 2002536617 | 10/2002 |
| JP | 2005090865 | 4/2005 |
| WO | 0046548 | 8/2000 |
| WO | 2004/092646 | 10/2004 |
| WO | 2004092646 | 10/2004 |

OTHER PUBLICATIONS

Kellner, Volkert: "Gas-Porenbrenner in Der . . . ", Heat Processing, [Online] BD. 2, Sep. 8, 2006, pp. 1-2, XP002443880.

* cited by examiner

HEATING DEVICE FOR PREHEATING A LIQUID-METAL TRANSFER CONTAINER

The invention concerns a heating device for preheating a vessel, such as a transfer ladle, that is used for transferring liquid metal in melting operations and is lined with refractory material, where the vessel is heated in a heating stand that has a vessel cover.

In melting operations, e.g., in steel mills, the molten metal is conveyed in the liquid state by ladles from one stage of metal product production to the next. In this operation, the ladle must not be cold before it is filled with the liquid metal. On the one hand, this requirement is due essentially to the fact that the filled liquid metal may be allowed to lose only a minimal amount of energy due to heat losses to the ladle. On the other hand, the refractory lining is sensitive to a suddenly occurring heat load after the ladle has been filled with metal, and this leads to a high degree of wear and tear of the refractory material. Therefore, the goal must be to keep the temperature difference between the ladle lining and the liquid metal as small as possible.

For this reason, before they are to be used, the transfer ladles for the liquid metal are preheated or kept hot in heating stands by burners, as described, for example, by EP 1 078 704 B1. The air-natural gas burners used for this purpose have a capacity of up to 4 MW and produce a flame that causes the exhaust gas to move rapidly, shows a tendency to cause stratification, and has only a relatively small fraction of radiant energy.

Aside from the fact that the energy of the energy carrier is thus poorly utilized, this also results in unnecessarily high $CO_2$ emissions. In addition, the stratification causes nonuniform heating of the ladle, which leads to thermal stresses and correspondingly high wear and tear of the lining material. Moreover, there is the problem that a residual amount of liquid metal left in the ladle reoxidizes.

Therefore, the objective of the invention is to create a heating device of this general type that does not have these disadvantages, so that better energy utilization is achieved, $CO_2$ emissions are reduced, and wear and tear on refractory material or lining material is reduced.

In accordance with the invention, this objective is achieved by the use of porous burners for heating the vessel, especially a transfer ladle, and maintaining its temperature. By using, for example, porous burners disclosed by WO 2004/092646 A1 for preheating and maintaining the temperature of liquid metal transfer vessels, the more efficient combustion of the energy carrier in the porous burner is thus utilized for this heating task. This reduces the amount of exhaust gas and yet produces an exhaust gas of spatially uniform temperature and discharge velocity, so that stratification can be avoided. Furthermore, a relatively large fraction of the energy that is introduced is converted to radiant energy in the porous burner. All together, this makes it possible to achieve economical and effective utilization of the energy, reduced $CO_2$ emissions, and more rapid heating of the vessel with uniform heating of the refractory material or the lining of the vessel.

In a preferred embodiment of the invention, the porous burners are constructed and arranged in the form of arrays. The construction of arrays of porous burners allows optimized use of the porous burners.

To this end, in accordance with an advantageous proposal of the invention, arrays of porous burners are provided, which are distributed with optimized utilization of space on the inner wall of the cover. In an advantageous alternative embodiment, a column is provided, which has arrays of porous burners that are distributed with optimized utilization of space and extends into the vessel through the cover.

In both cases, the hot exhaust gas enters the body of the furnace at a relatively low velocity in the cross-sectional outflow, and causes no stratification. At the same time, a high fraction of the energy is converted to radiation in the porous burner, and the radiation temperature is higher than the necessary temperature (1,100 to 1,200° C.) of the refractory material of the liquid metal transfer vessel.

In the embodiment of the device for heating and maintaining the temperature with a column that extends into the interior of the vessel to be heated, an advantageous design provides that the porous burners are arranged so as to be distributed over the entire circumference of the column. Even more effective action of the radiation can be realized by the column equipped with arrays of porous burners on the sides and optionally on the bottom.

If the column has the preferred polygonal construction, the construction of arrays of porous burners on the closed circumference of the column is simplified by virtue of the fact that the porous burners can be mounted in a simple way on the flat polygonal surfaces.

According to another proposal of the invention, a lifting device is assigned to the column. The raising and lowering of the column that this makes possible allows variable positioning of the heating column that can be adapted to the given heating task.

If, as is preferred, the column can also be rotated about its longitudinal axis, which can be accomplished in an advantageous way by the lifting device being designed for simultaneous rotation, even more uniform heating or heating up of the lining of the liquid metal transfer vessel can be achieved.

Additional features and details of the invention are revealed in the claims and in the following description of the specific embodiments illustrated in the drawings.

Figure 1:
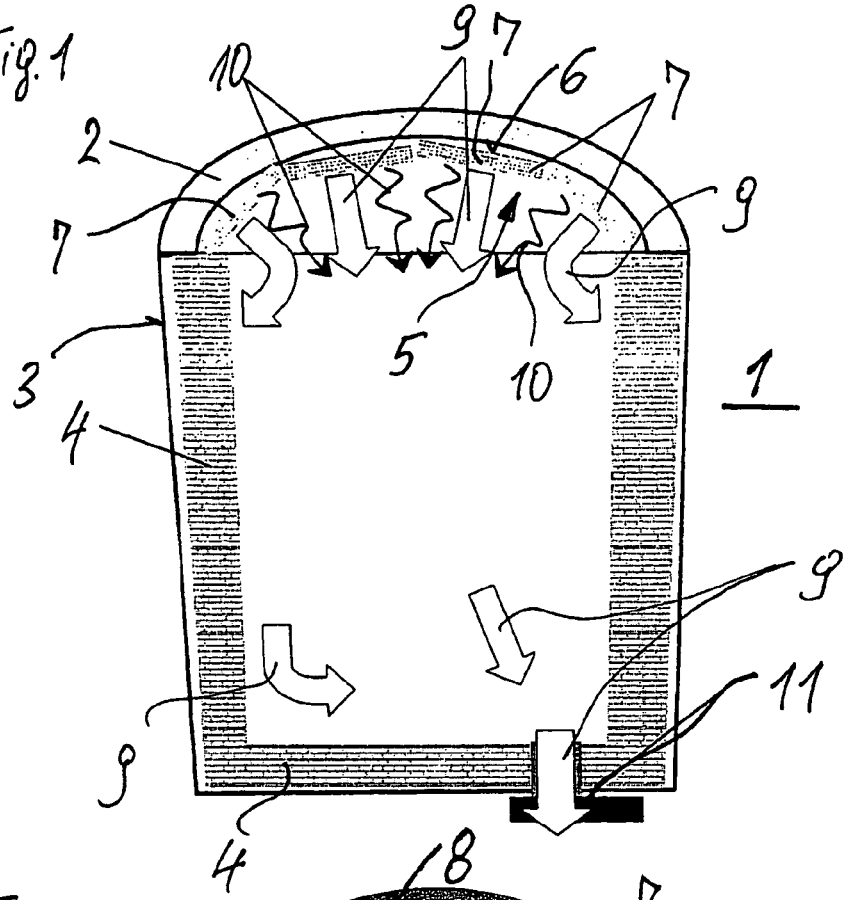
FIG. 1 is a schematic illustration of the vessel closed by a lid equipped with porous burners as an individual part of a heating stand for preheating and maintaining the temperature of a liquid metal transfer vessel.
Figure 3:
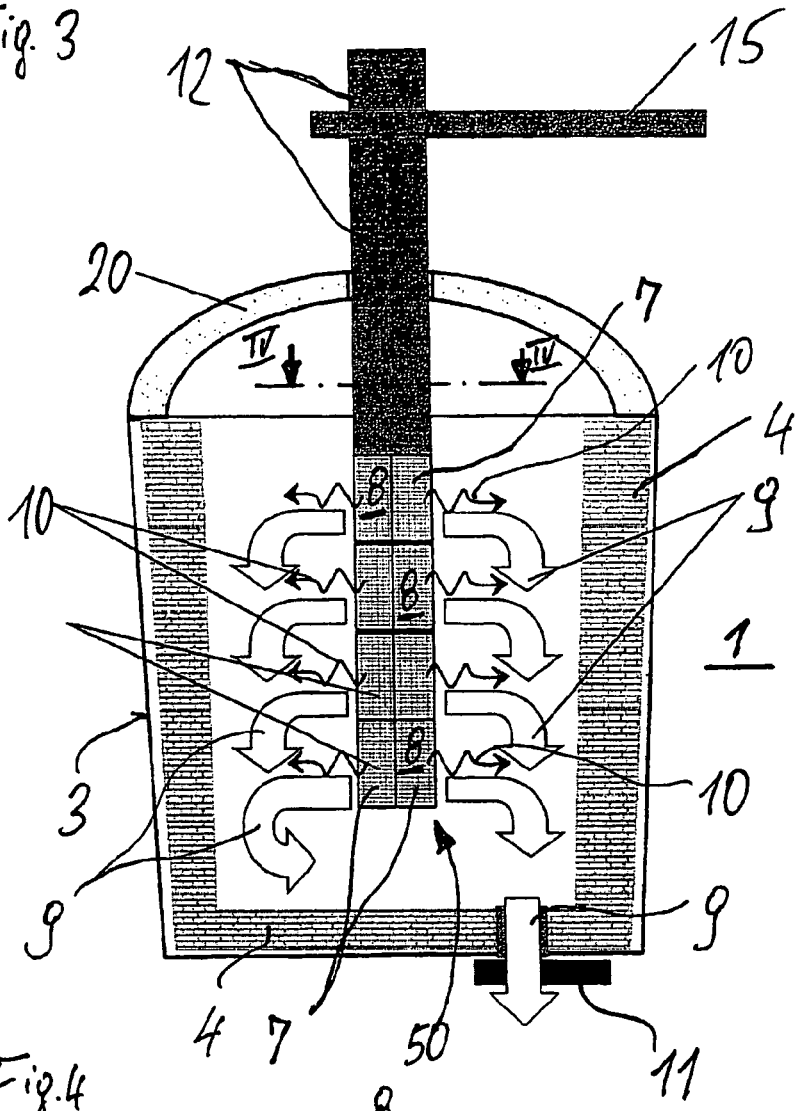
FIG. 3 is a schematic illustration similar to FIG. 1 but with arrays of porous burners constructed on a column that extends into the transfer vessel through the cover.

A liquid metal transfer vessel 3, which is to be preheated and/or kept hot, is realized here as a transfer ladle and is closed by a cover 2 or 20. This transfer vessel 3 is already positioned in a heating stand 1. The heating stand itself is of a standard design. It is equipped with a cover 2 or 20 that can be operated in the heating stand and is indicated in FIGS. 1 and 3 only by the reference number 1. The bottom surface and inside lateral surface of the transfer vessel 3 are lined with refractory material 4.

Figure 2:
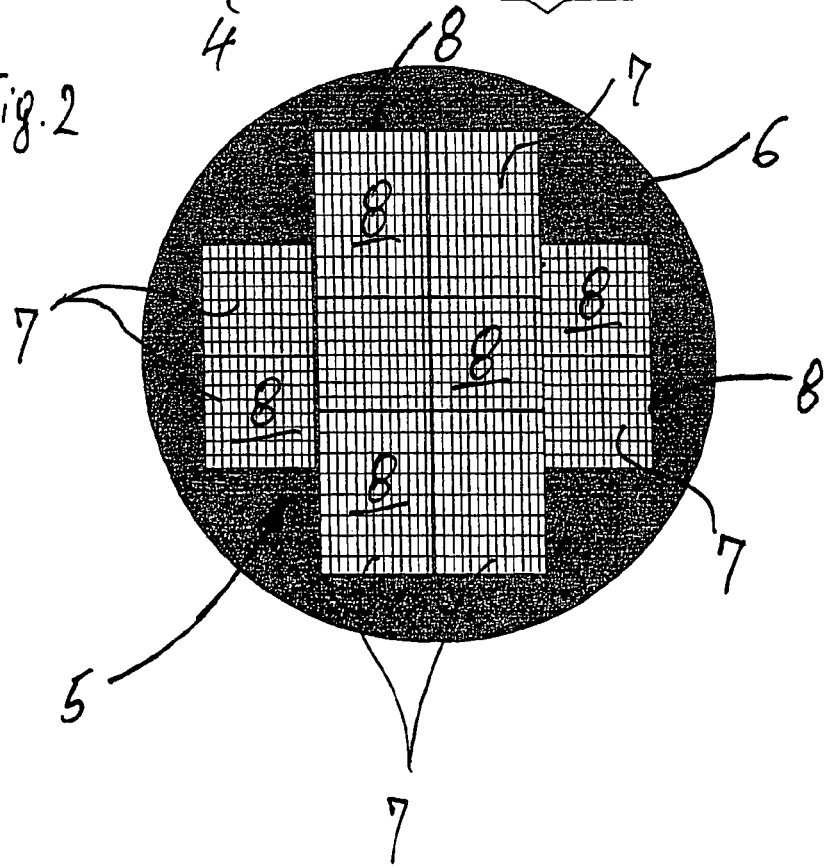
FIG. 2 is a highly schematic illustration of the cover according to FIG. 2, as seen from the inside.

In the embodiment illustrated in FIG. 1, a heating device 5 is provided on the inside wall 6 of the cover 2. As is shown in greater detail in FIG. 2, the heating device 5 consists of several porous burners 7, which are constructed as arrays 8 and are mounted with optimum utilization of space on the inside surface of the cover 2. The porous burners 7, which are connected to sources of an energy carrier and an oxygen carrier by supply lines (not shown), produce a hot exhaust gas 9, as indicated by arrows. This exhaust gas enters the interior of the vessel 3 at a relatively low velocity, has a uniform temperature distribution in the cross-sectional outflow of the arrays 8 of the porous burners 7, and causes no stratification. At the same time, a high fraction of the energy is converted to radiation in the porous burners 7, as illustrated by the arrows 10. The exhaust gas 9 is removed through openings in the bottom of the liquid metal transfer vessel 3. The openings can be closed by gate valves 11.

Figure 4:
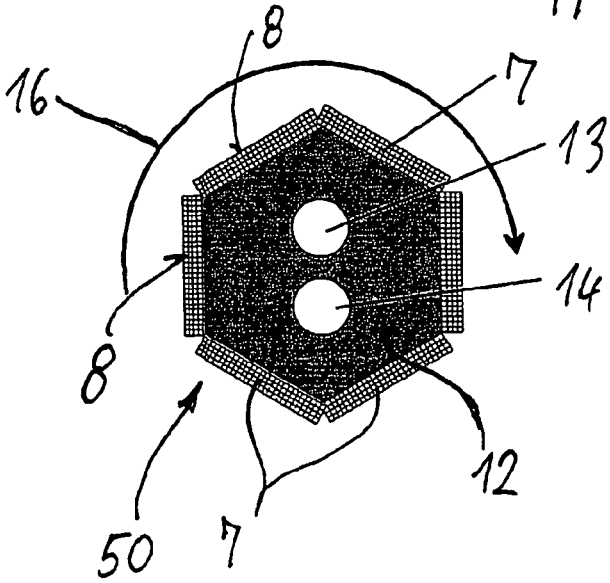
FIG. 4 shows a section along line IV-IV of FIG. 3.

In the embodiment according to FIGS. 3 and 4, the heating device 50 is provided on a column 12 that extends through the cover 20 into the liquid metal transfer vessel 3. The column 12 has a polygonal design (see FIG. 4), and the porous burners 7, which again are present in arrays 8 that are distributed with optimum utilization of space, are mounted on the polygonal surfaces in a way that completely surrounds the circumference of the column 12. FIG. 4 shows the supply lines 13 and 14 for the energy carrier and the oxygen carrier, e.g., air, for supplying the porous burners 7. The exhaust gases 9 and the radiation 10 are directed radially directly at the refractory material 4. As in the first embodiment, the exhaust gases 9 can then flow out or be removed through the openings in the bottom, which can be controlled by gate valves 11.

As is illustrated in a highly schematic way in FIGS. 3 and 4, the column 12 can be lowered or raised by a lifting device 15 for optimized positioning of the heating device 50 according to the heating task at hand. In addition, the column can be rotated about its longitudinal axis, as indicated by the rotational arrow 16, in order to provide uniform preheating of the refractory material 4 or to maintain it at a uniform temperature.

LIST OF REFERENCE NUMBERS

1 heating stand
2, 20 cover
3 liquid metal transfer vessel
4 refractory material
5, 50 heating device
6 inside wall
7 porous burner
8 array
9 exhaust gas
10 arrow (radiation)
11 gate valve
12 column
13 supply line (energy carrier)
14 supply line (oxygen carrier)
15 lifting device
16 rotational arrow

The invention claimed is:

1. A method for preheating a vessel for transferring liquid metal in melting operations, which vessel is lined with refractory material, comprising the steps of:

arranging the vessel in a heating stand;

covering the vessel with a cover;

arranging porous burners in arrays;

preheating the vessel with the porous burners for heating and maintaining temperature of the vessel; and providing a column that extends into the vessel through the cover, and distributing the arrays of the porous burners in the column.

2. The method in accordance with claim 1, including arranging the porous burners to be distributed over an entire circumference of the column.

3. The method in accordance with claim 1, wherein the column has a polygonal shape.

4. The method in accordance with claim 1, including providing a lifting device to lift the column.

5. The method in accordance with claim 1, including rotating the column about its longitudinal axis.

* * * * *